US010131071B2

(12) United States Patent
Kaneider

(10) Patent No.: US 10,131,071 B2
(45) Date of Patent: Nov. 20, 2018

(54) DEVICE SYSTEM INCLUDING A RADIO LINK

(71) Applicant: Hilti Aktiengesellschaft, Schaan (LI)

(72) Inventor: Wilfried Kaneider, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/509,164

(22) PCT Filed: Sep. 1, 2015

(86) PCT No.: PCT/EP2015/069938
§ 371 (c)(1),
(2) Date: Mar. 6, 2017

(87) PCT Pub. No.: WO2016/037899
PCT Pub. Date: Mar. 17, 2016

(65) Prior Publication Data

US 2017/0252946 A1 Sep. 7, 2017

(30) Foreign Application Priority Data

Sep. 8, 2014 (EP) ..... 14003096

(51) Int. Cl.

| | |
|---|---|
| ***B28D 7/00*** | (2006.01) |
| ***B25F 5/00*** | (2006.01) |
| ***B28D 1/04*** | (2006.01) |
| ***B25H 1/00*** | (2006.01) |

(52) U.S. Cl.
CPC ..... *B28D 7/005* (2013.01); *B25F 5/00* (2013.01); *B25H 1/0042* (2013.01); *B28D 1/042* (2013.01); *B28D 1/044* (2013.01); *B28D 1/045* (2013.01)

(58) Field of Classification Search
CPC ..... B28D 7/005; B28D 1/044; B28D 1/045; B26F 3/004
See application file for complete search history.

(56) References Cited

U.S. PATENT DOCUMENTS

| | | | |
|---|---|---|---|
| 7,337,037 B2 | 2/2008 | Schaer et al. | |
| 8,432,950 B2 | 4/2013 | Tanaka et al. | |
| 2007/0075834 A1* | 4/2007 | Armstrong | G06K 7/0008 340/10.1 |

(Continued)

FOREIGN PATENT DOCUMENTS

| | | |
|---|---|---|
| DE | 19737617 | 3/1999 |
| DE | 102010037820 | 3/2011 |

(Continued)

OTHER PUBLICATIONS

International Search Report of PCT/EP2015/069938, dated Nov. 5, 2015, 2 pages.

*Primary Examiner* — Nabil Syed
(74) *Attorney, Agent, or Firm* — Davidson, Davidson & Kappel, LLC

(57) ABSTRACT

A device system, including a remote control (13) having a device housing (31) and a first radio unit (38), a tool device with a second radio unit and a radio link which connects the first radio unit (38) of the remote control (13) to the second radio unit of the tool device. The first radio unit is (38) is arranged on a front side (57) of the device housing (31), wherein the front side (57) is lying opposite a rear side (56) of the device housing (31) facing the operator in a working position of the remote control (13).

3 Claims, 4 Drawing Sheets

(56) References Cited

U.S. PATENT DOCUMENTS

| | | | | |
|---|---|---|---|---|
| 2014/0336828 | A1* | 11/2014 | Gromes, Sr. | G06F 3/01 700/282 |
| 2015/0269400 | A1* | 9/2015 | Poussot | G06K 7/10346 340/10.1 |
| 2015/0375318 | A1 | 12/2015 | Brugger | |

FOREIGN PATENT DOCUMENTS

| | | | |
|---|---|---|---|
| EP | 1693173 | | 8/2006 |
| JP | S47-34771 | B | 9/1972 |
| JP | H077321 | A | 1/1995 |
| JP | 2010142318 | A | 7/2010 |
| JP | 2011072377 | A | 4/2011 |
| JP | 2012156969 | A | 8/2012 |
| WO | WO2014/124910 | | 8/2014 |
| WO | WO2014/128095 | | 8/2014 |

* cited by examiner

DEVICE SYSTEM INCLUDING A RADIO LINK

The present invention relates to a device system which includes a radio link.

BACKGROUND

HUSQVARNA offers a device system including a remote control, which is connectable to the device system via a radio link wirelessly and without cables. The device system is designed as a wall sawing system and includes a guide rail, a tool device displaceably situated on the guide rail, an electronic assembly and the remote control. The tool device is designed as a wall saw and includes a saw head and a motor-driven feed unit. The saw head includes a cutting tool, which is designed as a saw blade, and is driven around a rotation axis by a drive motor. The motor-driven feed unit includes a guide carriage and a feed motor; the saw head is situated on the guide carriage and displaced on the guide rail by the feed motor along a feed direction.

The remote control includes a device housing, an input device, a display device and a first control unit, which is situated in the interior of the device housing. The first control unit converts the inputs via the input device into control commands and data which are transmitted to the electronic assembly via a first communication link. The first communication link is designed as either a radio link or a first communication cable. The first communication cable is used if a wireless or cableless communication is not possible for safety reasons or due to sources of interference. The first communication cable is also used to clearly assign the remote control and the electronic assembly to each other.

The radio link forms between a first radio unit on the remote control and a second radio unit on the electronic assembly. The first radio unit includes a radio module having a first radio antenna, and the second radio unit includes a radio module having a second radio antenna. The first radio unit is situated in the device housing of the remote control, between a lower side of the device housing and the horizontally arranged first control unit, and the second radio unit is situated in the device housing of the electronic assembly, which is manufactured primarily from metal. The arrangement of the first and second radio units may impair the radio link.

SUMMARY OF THE INVENTION

It is an object of the present invention to increase the reliability of the radio link in a remote control which is connectable to a device system wirelessly and without cables via a radio link between a first radio unit and a second radio unit. The radio link is to have a sufficient reliability, in particular in device systems without a separate electronic assembly.

According to the present invention, the first radio unit is situated on a front side of the device housing, the front side being opposite a back side of the device housing facing the operator in a working position of the remote control.

The arrangement of the first radio unit on the front side of the device housing has the advantage that the front side represents the device side facing away from the operator. The front side of the device housing is also facing the tool device in the working position of the remote control. During cutting, the operator holds the remote control in the working position and directs his gaze to the cutting process.

The first radio unit preferably includes a first radio module having a first radio antenna and a second radio module having a second radio antenna, the polarization directions of the first and second radio antennas being situated essentially perpendicularly to each other. Due to the use of multiple radio modules having perpendicular radio antennas, the quality of the radio link between the remote control and the tool device may be improved.

The first and second radio module particularly preferably have an identical design. By using identical radio modules, the device costs for setting up of the radio link may be reduced.

In one preferred refinement, the first radio unit includes a third radio module having a third radio antenna, the polarization direction of the third radio antenna being situated essentially perpendicularly to the polarization directions of the first and second radio antennas. Due to the use of a third radio module having a perpendicular radio antenna to the radio antennas, the quality of the radio link between the remote control and the tool device may be improved. The radio antennas situated perpendicularly to each other span a three-dimensional space.

The distance between the first antenna base point of the first radio module and the second antenna base point of the second radio module particularly preferably essentially corresponds to an odd multiple of a quarter wavelength of a radio frequency.

The radio link between the remote control and the tool device has a frequency band including multiple radio frequencies between a lower radio frequency and an upper radio frequency. The distance between the first antenna base point of the first radio module and the second antenna base point of the second radio module is matched to the center frequency of the frequency band.

BRIEF DESCRIPTION OF THE DRAWINGS

Exemplary embodiments of the present invention are described below on the basis of the drawing. The latter is not necessarily intended to represent the exemplary embodiments true to scale but rather the drawing is presented in a schematic and/or slightly distorted form where useful for the purpose of explanation. With regard to additions to the teachings apparent from the drawing, reference is hereby made to the relevant prior art. It should be taken into account that a variety of modifications and changes relating to the form and detail of a specific embodiment may be undertaken without deviating from the general idea of the present invention. The features of the present invention disclosed in the description, the drawing and the claims may be essential to the refinement of the present invention both individually and in any combination. All combinations of at least two of the features disclosed in the description, the drawing, and/or the claims are also within the scope of the present invention. The general idea of the present invention is not limited to the exact form or the detail of the preferred specific embodiment illustrated and described below, nor is it limited to an object which would be limited in comparison to the object claimed in the claims. In given measurement ranges, values within the specified limits are also to be disclosed as limiting values and be able to be arbitrarily used and claimed. For the sake of simplicity, the same reference numerals are used below for identical or similar parts or for parts having identical or similar functions.

DETAILED DESCRIPTION

Figure 1:
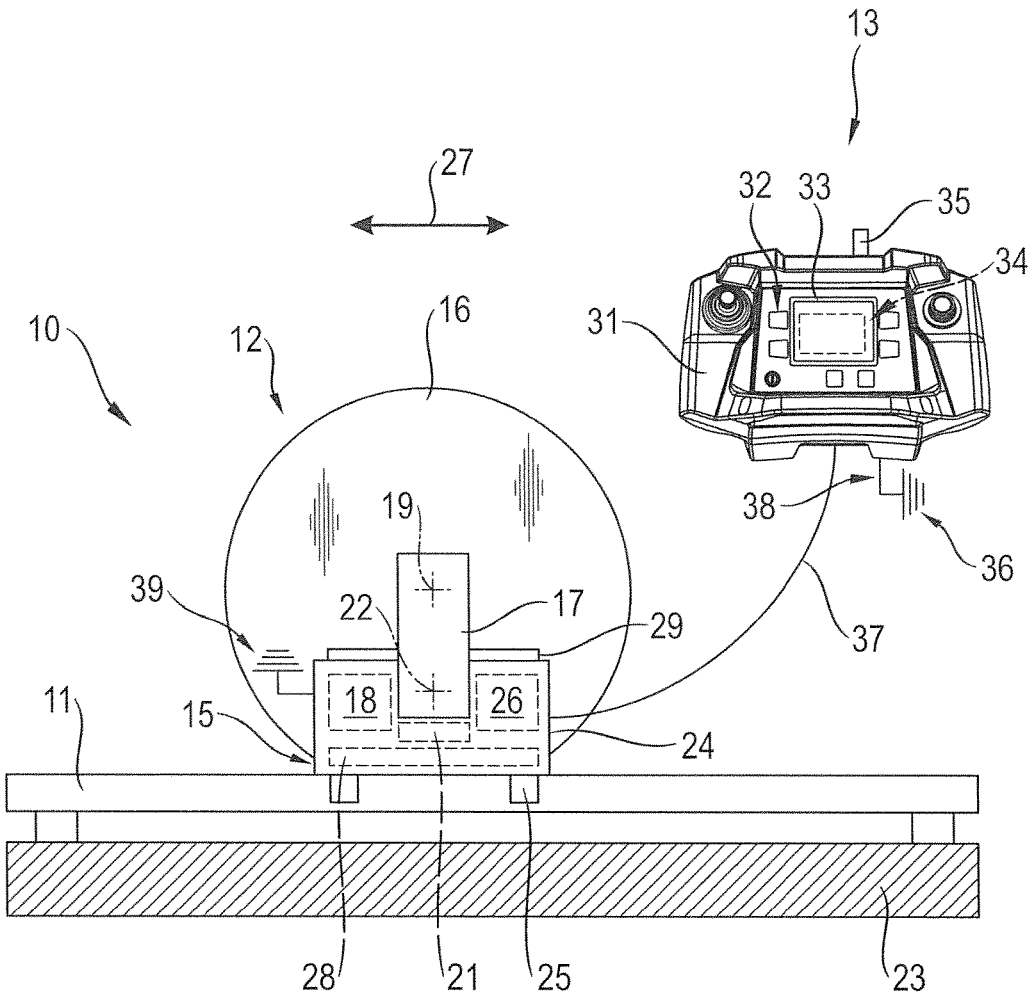
FIG. 1 shows a device system according to the present invention, which is designed as a wall sawing system, including a remote control and a tool device, which are connectable to each other via a radio link.

FIG. 1 shows a device system 10 according to the present invention, which is designed as a wall sawing system. Wall sawing system 10 includes a guide rail 11, a tool device 12, which is displaceably situated on guide rail 11, and a remote control 13. The tool device is designed as a wall saw 12 and includes a cutting unit 14 and a motor-driven feed unit 15. The cutting unit is designed as a saw head 14 and includes a cutting tool 16 designed as a saw blade, which is fastened to a saw arm 17 and is driven around a rotation axis 19 by a drive motor 18.

To protect the operator, saw blade 16 may be surrounded by a saw blade guard, which is fastened on saw arm 17 with the aid of a blade guard holder. Saw arm 17 is designed to be pivotable around a pivot axis 22 with the aid of a swing motor 21. The pivot angle of saw arm 17 determines, with the aid of a saw blade diameter of saw blade 16, how deep saw blade 16 dips into a workpiece 23 to be cut. Drive motor 18 and swing motor 21 are situated in a device housing 24. Motor-driven feed unit 15 includes a guide carriage 25 and a feed motor 26, which is also situated in device housing 24. Saw head 14 is fastened on guide carriage 25 and is designed to be displaceable by feed motor 26 along guide rail 11 in a feed direction 27. In addition to motors 19, 21, 25, a control unit 28 for controlling saw head 14 and motor-driven feed unit 15 is also situated in device housing 24. At least one handle 29 is provided on device housing 24.

Remote control 13 includes a device housing 31, an input device 32, a display device 33 and a control unit 34, which is situated in the interior of device housing 31. Control unit 34 converts the inputs of input device 32 into control signals and data, which are transmitted to wall saw 12 via a communication link. In addition to input device 32, remote control 13 also includes a control element 35 designed as an emergency off switch.

The communication link is designed as a wireless and cableless communication link 36 or as a communication cable 37. The wireless and cableless communication link is designed in the exemplary embodiment as a radio link 36, which forms between a first radio unit 38 on remote control 13 and a second radio unit 39 on tool device 12. Communication cable 37 is used, in particular, when a wireless and cableless communication is prohibited for safety reasons, for example in hospitals and airports, or when sources of interference hinder the wireless and cableless communication.

Figure 2A:
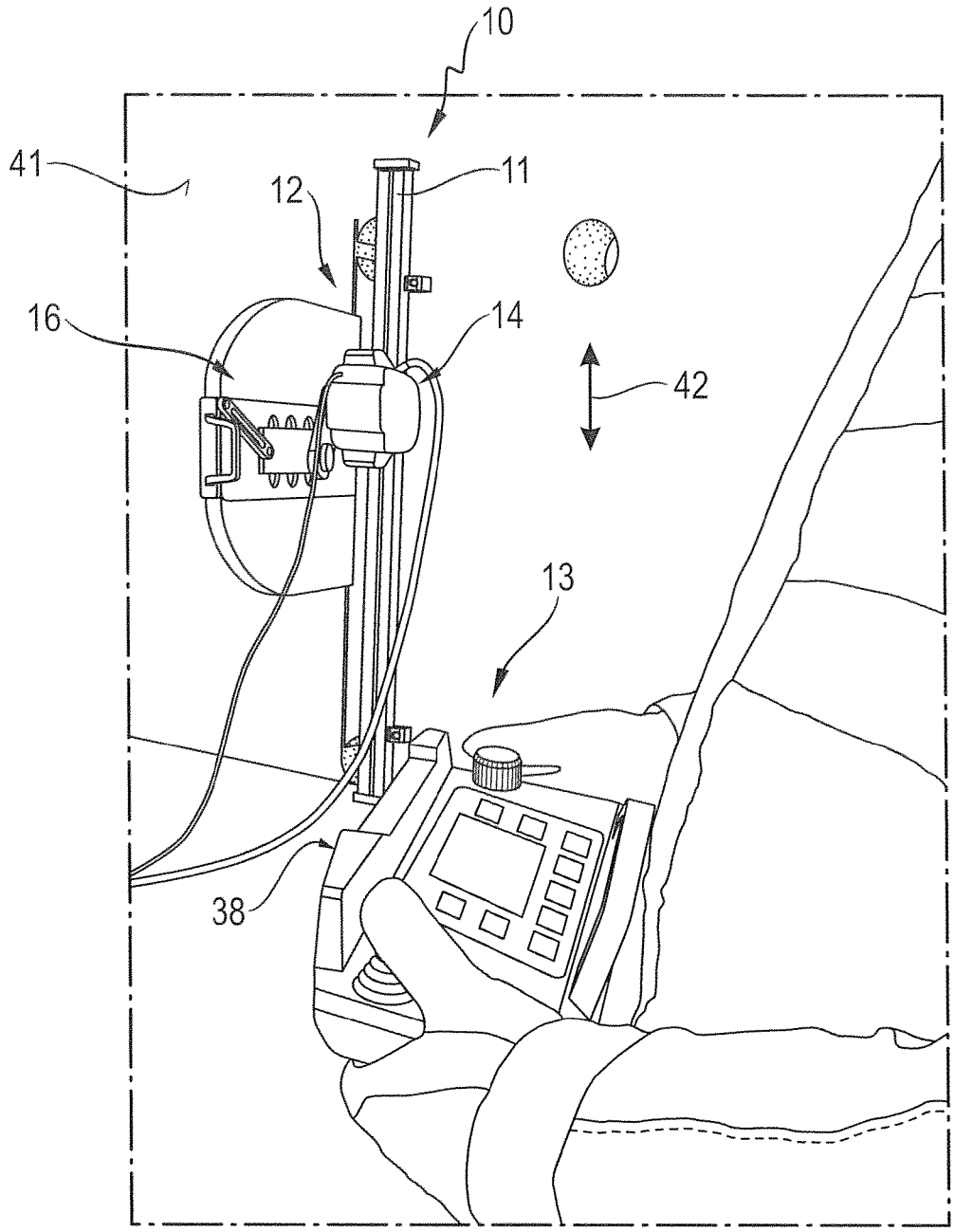
FIGS. 2A, 2B show the use of the wall sawing system according to the present invention from FIG. 1 during the cutting of a concrete wall in a vertical arrangement (FIG. 2A) and in a horizontal arrangement (FIG. 2B)
Figure 2B:
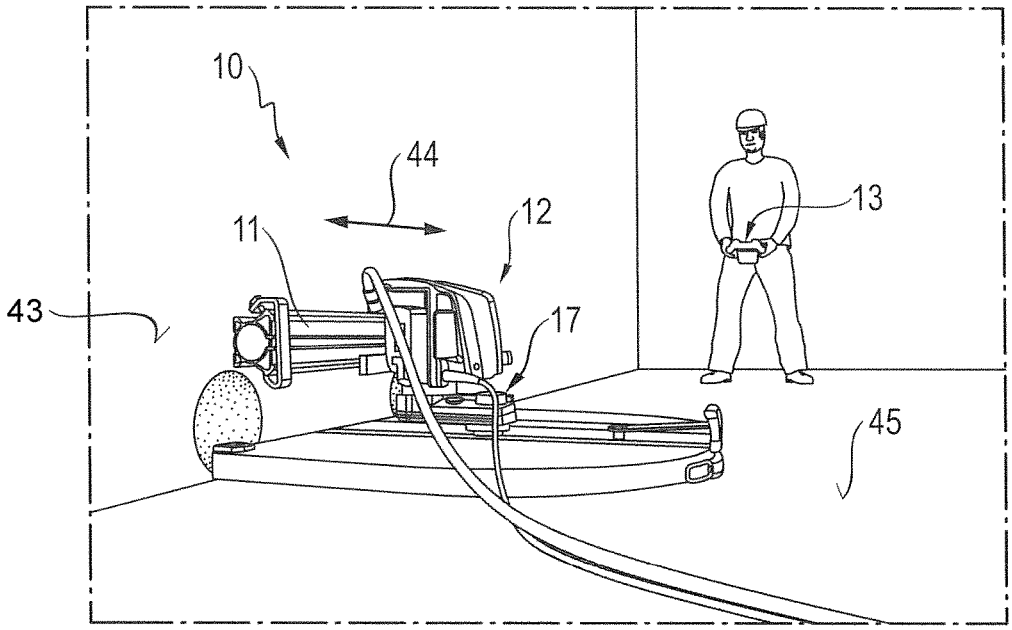

FIGS. 2A, 2B show the use of wall sawing system 10 according to the present invention from FIG. 1 during the cutting of a concrete wall in a vertical arrangement of wall sawing system 10 (FIG. 2A) and in a horizontal arrangement of wall sawing system 10 (FIG. 2B).

FIG. 2A shows wall sawing system 10, including guide rail 11 of wall saw 12 and remote control 13, during the cutting of a first concrete wall 41. Guide rail 11 is fastened on first concrete wall 41 in a vertical direction 42. The operator holds remote control 13 in his hands in a working position and directs his gaze onto the cutting work on wall 41.

FIG. 2B shows wall sawing system 10, including guide rail 11, wall saw 12 and remote control 13, during the cutting of a second concrete wall 43. Guide rail 11 is fastened on second concrete wall 43 in a horizontal direction 44. The operator holds remote control 13 in his hands in a working position and directs his gaze onto the cutting work on wall 43.

Radio link 36 between remote control 13 and wall saw 12 is impaired by various factors. During cutting, a cooling and rinsing fluid is used, which makes the surface to be cut and adjacent areas wet. The blade guard and saw blade 16, both of which are manufactured from metal, also impair radio link 37.

Figure 3A:
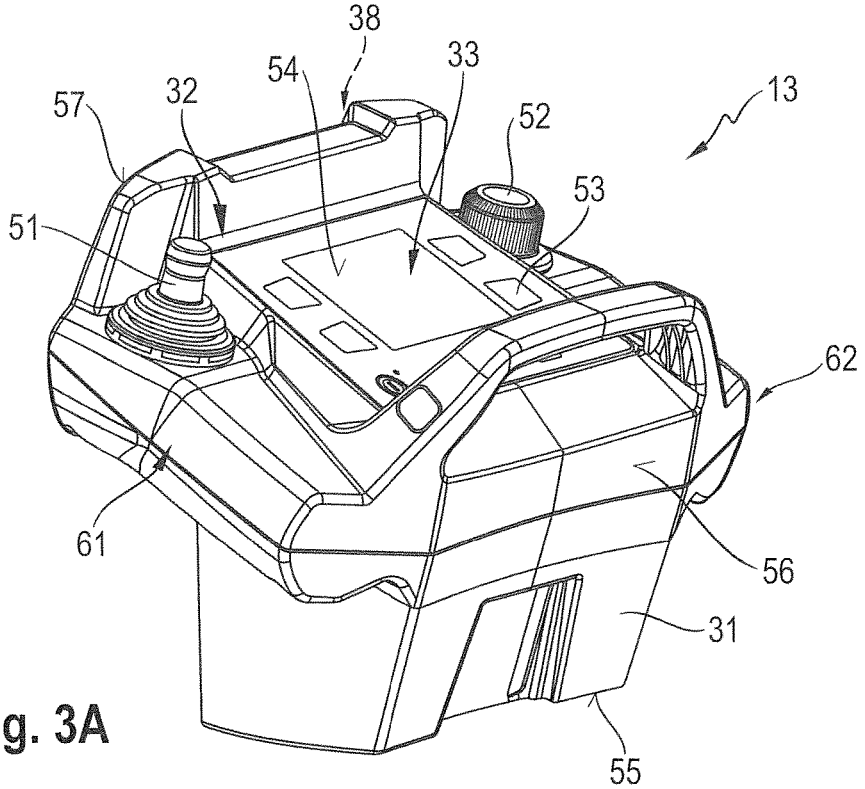
FIGS. 3A, 3B show the remote control from FIG. 1 in a view of an upper side of the device housing (FIG. 3A) and in a view of a front side of the device housing (FIG. 3B).
Figure 3B:
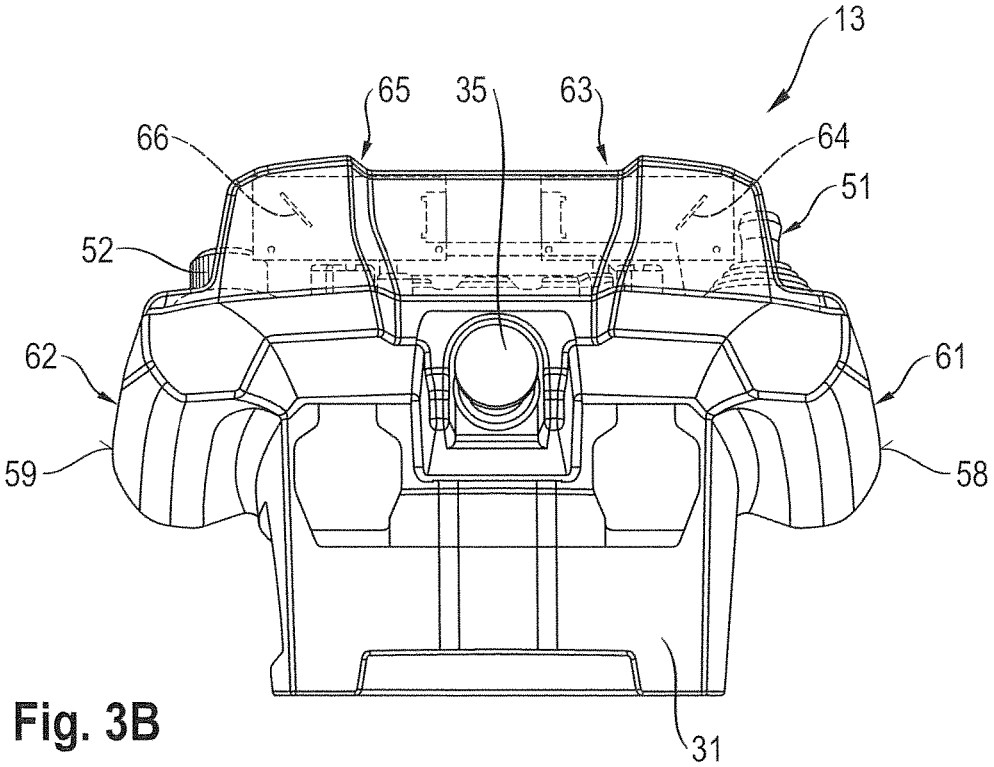

FIGS. 3A, 3B show remote control 13 in an oblique view of an upper side (FIG. 3A) of remote control 13 and in a view of a front side thereof (FIG. 3B). Remote control 13 is part of device system 10 according to the present invention from FIG. 1.

Remote control 13 includes device housing 31, input device 32, display device 33 and control unit 34, which is situated in the interior of device housing 31. Input device 32 includes multiple input elements, which are designed as joystick 51, as knob 52 and as pushbuttons 53. Depending on device system 10 and the complexity of the cutting method, the operator must set different cutting and device parameters. Input device 32 may therefore include additional input elements besides the input elements shown in FIG. 2A.

Device housing 31 includes an upper side 54, a lower side 55, which is opposite upper side 54, a back side 56, a front side 57, which is opposite back side 56, a left side surface 58 and a right side surface 59. Input device 32 and display device 33 are situated on upper side 54.

To ensure a secure grip during the remote control operation, device housing 31 includes two side holding elements 61, 62, which are mounted on left side surface 58 and right side surface 59. The side holding element mounted on left side surface 58 is also referred to as left holding element 61, and the side holding element mounted on right side surface 59 is also referred to as right holding element 62. The remote control of wall sawing system 10 takes place with the aid of remote control 13, which the operator holds in the working position illustrated in FIGS. 2A, 2B during the operation of wall sawing system 10. In the working position, the operator grips the side holding elements with the inner surfaces of his hands and operates the two input elements 51, 52 with his thumbs. Joystick 51 is operated with the thumb of the left hand, and knob 52 is operated with the thumb of the right hand.

Control unit 34 converts the inputs of input device 32 into control commands and data, which are transmitted to wall saw 12 via the first communication link. The first communication link is designed as radio link 36 between first and second radio units 38, 39 or as communication cable 37. First radio unit 38 is provided in device housing 31 of remote control 13. In the exemplary embodiment in FIG. 3B, first radio unit 38 includes a first radio module 63 having a first radio antenna 64 and a second radio module 65 having a second radio antenna 66, the polarization directions of first and second radio antennas 64, 66 being situated essentially perpendicularly to each other. In the exemplary embodiment in FIG. 3B, first and second radio modules 63, 65 have an identical design. To situate the polarization directions of the two radio antennas 64, 66 perpendicularly to each other, second radio module 65 is shifted with respect to first radio module 63 in device housing 31 and situated in a rotated manner.

To set up radio link 36, a frequency band having multiple radio frequencies is used between a lower radio frequency $f_{min}$ and an upper radio frequency $f_{max}$. If 15 equidistant radio frequencies are used between a lower radio frequency $f_{min}$ of 2.405 GHz and an upper radio frequency $f_{max}$ of 2.475 GHz, this results in a center frequency of 2.440 GHz.

The distance between the base point of the first radio antenna and the base point of the second radio antenna corresponds to an odd multiple of a quarter wavelength of a radio frequency of 2.440 GHz.

What is claimed is:

1. A device system comprising:

a remote control having a device housing, an input device situated in an upper side of the device housing, a control unit situated within the device housing and a first radio unit;

a tool device including a cutting tool, a drive motor driving the cutting tool, another control unit controlling the drive motor, and a second radio unit;

a radio link connecting the first radio unit of the remote control to the second radio unit of the tool device;

the first radio unit being situated on a front side of the device housing, the front side being situated opposite a back side of the device housing facing the operator in a working position of the remote control;

wherein the first radio unit includes a first radio module having a first radio antenna and a second radio module having a second radio antenna, polarization directions of the first and second radio antennas being situated perpendicularly to each other; wherein a distance between a first antenna base point of the first radio module and a second antenna base point of the second radio module corresponds to an odd multiple of a quarter wavelength of a radio frequency; wherein the radio link has a frequency band including multiple radio frequencies between a lower radio frequency ($f_{min}$) and an upper radio frequency ($f_{max}$); and wherein the distance between the first antenna base point of the first radio module and the second antenna base point of the second radio module is matched to a center frequency of the frequency band ($f_{min}$, $f_{max}$).

2. The device system as recited in claim 1 wherein the first and second radio modules have an identical design.

3. The device system as recited in claim 1 wherein the first radio unit includes a third radio module having a third radio antenna, a polarization direction of the third radio antenna being situated perpendicularly to the polarization directions of the first and second radio antennas.

* * * * *